US008207656B2

(12) United States Patent
Baumgartner et al.

(10) Patent No.: US 8,207,656 B2
(45) Date of Patent: Jun. 26, 2012

(54) B-K ELECTRODE FOR FIXED-FREQUENCY PARTICLE ACCELERATORS

(76) Inventors: Heidi Baumgartner, New York, NY (US); Timothy William Koeth, Alexandria, VA (US)

( * ) Notice: Subject to any disclaimer, the term of this patent is extended or adjusted under 35 U.S.C. 154(b) by 0 days.

(21) Appl. No.: 12/929,937

(22) Filed: Feb. 25, 2011

(65) Prior Publication Data

US 2011/0227470 A1 Sep. 22, 2011

Related U.S. Application Data

(60) Provisional application No. 61/282,537, filed on Feb. 26, 2010.

(51) Int. Cl.
*H05H 13/00* (2006.01)

(52) U.S. Cl. ..... 313/62; 315/500; 315/501

(58) Field of Classification Search ..... 313/62; 315/500–507
See application file for complete search history.

(56) References Cited

U.S. PATENT DOCUMENTS 1,948,384 A 2/1934 Lawrence
2,615,129 A 10/1952 McMillan
4,197,510 A 4/1980 Szu
7,880,408 B2 * 2/2011 Calabretta et al. ..... 315/502
2008/0094011 A1 * 4/2008 Calabretta et al. ..... 315/502

OTHER PUBLICATIONS

Lawrence, E. O., The Production of High Speed Light Ions Without the Use of High Voltages, Physical Review, 1932, vol. 40, pp. 19-35.
Bethe, H. A. and Rose, M. E., The Maximum Energy Obtainable from the Cycltron. Physical Review, 1937, vol. 52, pp. 1254-1255.
Bohm, D, and Foldy, L. L.,Theory of the Synchro-Cyclotron, Physical Review, 1947, vol. 72, pp. 649-661.
Thomas, L. H., The Paths of Ions in the Cyclotron II Paths in the Combined Electric and Magnetic Fields, Physical Review, 1938, vol. 54, pp. 588-598.
Richardson, J., et al, Frequency Modulated Cyclotron, Physical Review, 1946, vol. 69, pp. 669-670.
M.M. Gordon, Effects of Spiral Electric Gaps in Superconducting Cyclotrons, Nuclear Instruments and Methods, Mar. 1980, pp. 327-336, vol. 169, North-Holland Publishing Co., The Netherlands.
S. Adam, New Proofs for Old Facts in Acceleration Theory, Ninth International Conference on Cyclotrons and their Applications, Sep. 1981, pp. 431-433, Les Editions de Physique, France.
P. Laspostolle, Recent Developments on Beam Dynamics in Cyclotrons, Ninth International Conference on Cyclotrons and their Applications, Sep. 1981, p. 317-326, Les Editions de Physique, France.

* cited by examiner

*Primary Examiner* — Tracie Y Green
(74) *Attorney, Agent, or Firm* — Koeth Law, P.L.L.C.; Michelle M. Koeth, Esq.

(57) ABSTRACT

An electrode for fixed-frequency particle accelerators geometrically compensating for relativistic mass increase by placing the acceleration gap at the location of the particle at each peak of the accelerating electric field.

13 Claims, 2 Drawing Sheets

B-K ELECTRODE FOR FIXED-FREQUENCY PARTICLE ACCELERATORS

RELATED APPLICATIONS

This application is related to U.S. Provisional Application No. 61/282,537 filed Feb. 26, 2010, and claims the benefit of that filing date

BACKGROUND

The cyclotron is a device used to accelerate charged particles to high velocity. In the cyclotron, charged particles are confined to circular orbits by a magnetic field, and are accelerated with an electric field created by two hollow conductive semicircular electrodes termed dees. The frequency of the oscillating electrical potential across the dees is timed to be equal to the orbital frequency of the charged particle in the magnetic field, and it is constant as the energy of the particle increases with every turn. The particles in the cyclotron experience a resonant energy-multiplying effect as they always traverse the gap between the dees when the oscillatory electric field is at its maximum.

Problems arise when particles in the cyclotron attain speeds that are an appreciable fraction of the speed of light, and, according to the theory of special relativity, gain mass proportional to their kinetic energy. The increased mass causes the particles' resonant cyclotron frequency to change, and they fall out of step with the applied electric field. Thus, as discussed in H. A. Bethe and M. E. Rose. 1937, The Maximum Energy Obtainable from the Cyclotron, Phys. Rev. 52: 1254-1255, the traditional cyclotron is fundamentally limited in the energy it can attain due to its fixed frequency and magnetic field.

Existing methods of overcoming relativistic mass increase and resonant frequency shift in the cyclotron also introduce severe limitations. As discussed in U.S. Pat. No. 2,615,129, and D. Bohm and L. L. Foldy. 1947. Theory of the Synchro-Cyclotron, Phys. Rev. 72: 649-661, Synchrocyclotrons modulate the cyclotron frequency with time, to keep a single packet of particles synchronous throughout the accelerator at a time. Synchrocyclotrons can accelerate to higher energies, but they yield only low-intensity beams of particles, as the duty cycle of the accelerated beam is small. Isochronous cyclotrons continue to drive relativistic particles with a constant frequency by increasing magnetic field strength with increasing radius, as the cyclotron frequency is given by:

$$f = \frac{qB}{2\pi M}$$

where B is magnetic field strength, q is charge of the particle, and M is the mass of the particle.

However, isochronous cyclotrons are also limited in that for the most efficient use of space, and the most cost-efficient way to attain high-energy particles, the magnetic field would be as high as possible throughout the acceleration area. With conventional resistive electromagnets, an iron yoke saturates at about 2 Tesla, and the magnet cannot be operated at a higher field; to attain higher-energy particles would require increasing the magnet's radius while still keeping the correct gradient, resulting in a smaller magnetic field in the center. Further, weak-focusing cyclotrons cannot be isochronous, and therefore, more complicated beam focusing techniques must be used in isochronous cyclotrons.

SUMMARY

The inventors propose a novel accelerating electrode design that geometrically compensates for the relativistic mass increase of the particle. Rather than modulating the frequency or magnetic field to compensate for the accelerated particles' relativistic mass increase, the inventors propose a particular shape of the dees or electrodes, which is designed to accommodate the particles' changing path length per oscillatory cycle at the fundamental frequency.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

So that those of ordinary skill in the art to which the subject invention pertains will more readily understand how to make and use the device described herein, one or more embodiments of the invention will be described in detail with reference to the drawings, wherein.

DETAILED DESCRIPTION

Reference is now made to the accompanying figures for the purpose of describing, in detail, one or more embodiments of the invention. The figures and accompanying detailed description are provided as examples of the invention and are not intended to limit the scope of the claims appended hereto.

Figure 1:
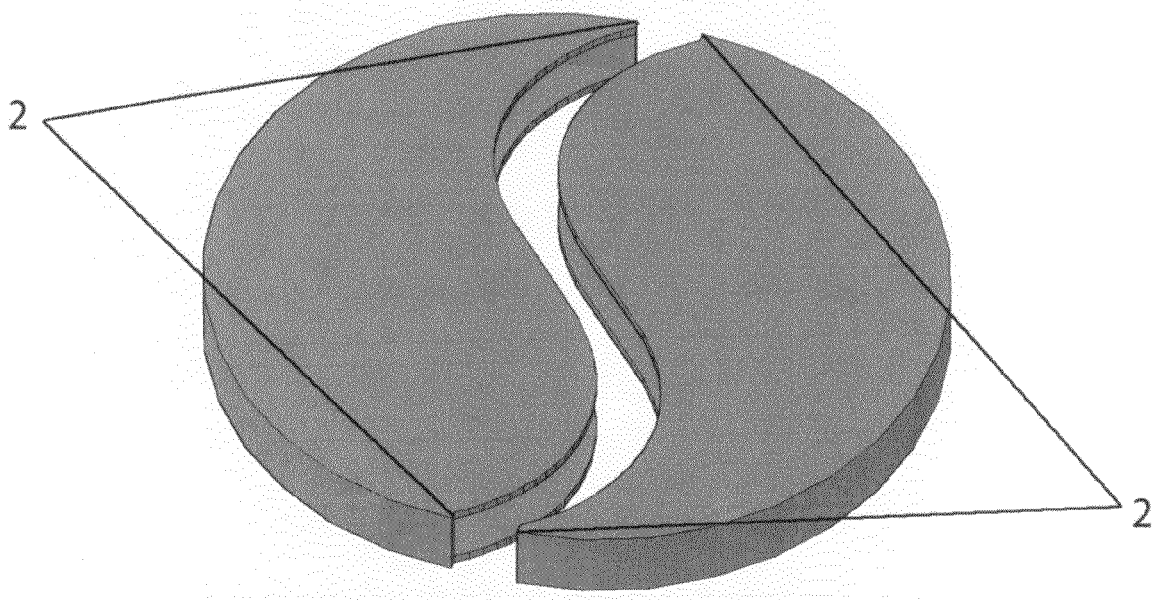
FIG. 1 illustrates the general shape of an embodiment of the B-K electrode.
Figure 2:
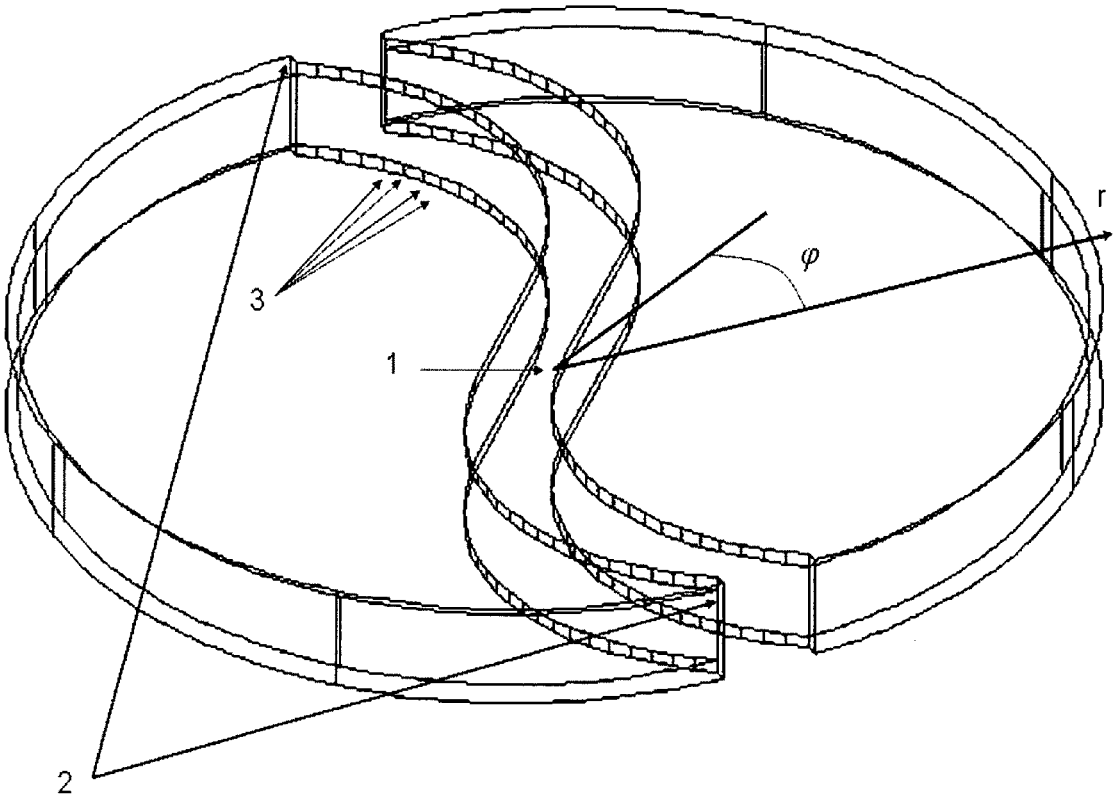
FIG. 2 illustrates a wireframe view of the general shape of an embodiment of the B-K electrode.

FIG. 1 illustrates the general shape of the B-K electrode. Referring to FIG. 2, the shape of the B-K electrode can be determined with the following relations:

$$\varphi = \tau_o\omega - \tau_o\omega_o$$

$$r = \frac{qB}{\gamma m_o \beta c}$$

Where $\phi$ is the angular displacement of the relativistic particles from the centerpoint 1 as a function of turn number, r is the radial displacement, $\tau_O$ is the fundamental period of the electric field's oscillation, $\omega$ is the orbital frequency of the relativistic particle, and $\omega_O$ is the non-relativistic particle's fundamental frequency in the magnetic field B. c is the speed of light, $m_o$ is the particle's rest mass, $\gamma$ and $\beta$ are relativistic factors, here expressed as a function of turn number n, and dependent upon acceleration voltage $V_o$, where $E_O$ is the non-relativistic particle's rest energy, and q is the charge of the particle.

$$\gamma = 1 + \frac{nV_o q}{E_o}$$

$$\beta = \sqrt{1 - \frac{1}{\gamma^2}}$$

Plotting r, ϕ in polar coordinates results in a series of points at which the particle will be found at successive maxima of the electric field. As shown in FIG. 2, a curved aperture 2 comprised of these points 3 determines the shape of the B-K electrode.

Use of one or more embodiments discussed herein are not limited in scope and it is contemplated for use within fixed-frequency particle accelerators, including synchrocyclotrons as well as isochronous cyclotrons. In these applications, the B-K electrode provides a geometric compensation for relativistic effects. In the case of the synchrocyclotron, the B-K electrode geometrically allows a certain amount of phase shift, decreasing the amount that the frequency needs to be modulated, thereby increasing the duty cycle.

Although a few embodiments have been shown and described, it would be appreciated by those skilled in the art that changes might be made in these embodiments without departing from the principles and spirit of the invention, the scope of which is defined in the claims and their equivalents.

What is claimed is:

1. An electrode for a fixed-frequency particle accelerator comprising an aperture, wherein a curve of the aperture is defined by a series of points at which accelerated particles will be found at successive maxima of an electric field between the aperture and an other aperture.

2. The electrode as claimed in claim 1 wherein the series of points is defined by plotting r, ϕ polar coordinates, wherein r is the radial displacement and ϕ is the angular displacement of the relativistic particles from a center point of the aperture and the other aperture.

3. The electrode as claimed in claim 2 wherein r is determined by the following relation:

$$r = \frac{qB}{\gamma m_o \beta c},$$

where B is a magnetic field, c is the speed of light, $m_o$ is the particle's rest mass, and γ and β are relativistic factors.

4. The electrode as claimed in claim 2 wherein is determined by the following relation:

$$\phi = \tau_o \omega - \tau_o \omega_o$$

where ϕ is an angular displacement of the relativistic particles, $\tau_o$ is a fundamental period of an electric field's oscillation, ω is an orbital frequency of a relativistic particle, and $\omega_o$ is a non-relativistic particle's fundamental frequency in a magnetic field.

5. The electrode as claimed in claim 1 wherein the fixed-frequency particle accelerator is a cyclotron.

6. The electrode as claimed in claim 1 wherein the fixed-frequency particle accelerator is a synchrocyclotron.

7. The electrode as claimed in claim 1 wherein the fixed-frequency particle accelerator is an isochronous cyclotron.

8. A curved electrode wherein the curve is defined by a series of points at which accelerated particles will be found at successive maxima of an electric field.

9. The electrode as claimed in claim 8 wherein the electrode comprises an aperture, and wherein the electrode is curved along the aperture.

10. The electrode as claimed in claim 8 wherein the curve is a spline fit to the series of points.

11. An electrode comprising an aperture, wherein the aperture has a curved shape defined by a series of points at which accelerated particles will be found at maxima of an electric field between the aperture and an other aperture.

12. The electrode as claimed in claim 9 wherein the electrode is for a cyclotron.

13. The electrode as claimed in claim 9 wherein the maxima result from successive radio frequency cycles of an accelerating voltage.

* * * * *